United States Patent [19]

Calsson et al.

[11] Patent Number: 4,853,052

[45] Date of Patent: Aug. 1, 1989

[54] METHOD FOR PRODUCING A PYROTECHNICAL CHARGE

[75] Inventors: Staffan Calsson; Tore Boberg; Conny Sjöqvist, all of Karlskoga, Sweden

[73] Assignee: Aktiebolaget Bofors, Bofors, Sweden

[21] Appl. No.: 248,707

[22] Filed: Sep. 26, 1988

[30] Foreign Application Priority Data

Sep. 29, 1987 [SE] Sweden ..... 8703742

[51] Int. Cl.[4] ..... D03D 23/00

[52] U.S. Cl. ..... 149/109.6; 149/22; 149/40; 149/44; 264/3.1; 264/3.4

[58] Field of Search ..... 149/109.6, 44, 40, 22; 264/3.1, 3.4

[56] References Cited

U.S. PATENT DOCUMENTS 3,942,445 3/1976 Baker et al. ..... 149/22

3,954,530 5/1976 Holloway et al. ..... 149/22

4,080,227 3/1978 Hartzel et al. ..... 149/22

4,129,465 12/1978 Johnson et al. ..... 149/22

4,419,153 12/1983 Boberg ..... 149/22

*Primary Examiner*—Stephen J. Lechert, Jr.

*Attorney, Agent, or Firm*—Pollock, Vande Sande & Priddy

[57] ABSTRACT

The disclosure relates to a method of producing pyrotechnical charges by mixing and granulating the included components in water, a considerable advantage from the point of view of safety. The method according to the invention also makes it possible to vary the percentage concentration of the included components so that the obtained pyrotechnical charges can either be used as delay charges or as ignition charges. Since, moreover, an acrylate binder is included, they will obtain superior mechanical strength properties.

6 Claims, No Drawings

METHOD FOR PRODUCING A PYROTECHNICAL CHARGE

TECHNICAL FIELD

The present invention relates to a new type of pyrotechnical charge for ignition and delay purposes. The burning properties of the pyrotechnical charge may thus, within its own fundamental characteristics, be modified from rapid cascade combustion with continually ejected glowing particles as required by an ignition charge, to the delay charge version with its calm and clearly defined behavior with respect to rate of burning. The present invention also relates to a particularly preferred method of producing the pyrotechnical charge in question. Within the percentage concentrations characteristic of the present invention, the pyrotechnical charge may be given an optional rate of burning of between 3 and 150 mm/sec.

Nevertheless, the perhaps most manifest advantage inherent in the pyrotechnical charge according to the present invention is that the charge solely includes such active components as themselves do not react with water and as are sufficiently sparingly soluble in water to make it possible to mix and granulate the pyrotechnical charge wholly in water. Moreover, the binder included in the pyrotechnical charge is an aqueous dispersed acrylate, making it possible to add the binder in the mixing water and thereby to obtain a high strength of the finished granulate and molded bodies. After the final mixing, which thus takes place in water and which can also include a necessary pulverization or grinding of the included components, these form after possible dewatering a viscous paste which is dried and granulated and is thereafter ready for use, either directly or after pressing into homogeneous charges or pellets of the desired size and shape. Since the pyrotechnical charge according to the present invention may be wholly completed in water, it has become possible to virtually entirely eliminate the explosion risks inherent in such production, which, as compared with prior-art technology, in its turn has made possible a marked increase in the batch sizes during the actual production process - a feature which has long been desirable in this art but has been rendered impossible for reasons of safety. As a rule, previously known pyrotechnical charges have always contained one or more components readily soluble in water and consequently it has never been possible to finally mix such components in water.

On the other hand, it has long been a clearly expressed desire within this art to be able to produce certain pyrotechnical charges under safer conditions. The reason for this is that prior-art processes - whether they were completely dry or included the use of solvents - have entailed such a level of risk that every mixing batch has had to be kept small in size for reasons of safety, which in turn has led to low capacity and high prices.

The pyrotechnical charge according to the present invention thus satisfies a well-known desire on the manufacturing side of this art. The fact that its rate of burning, by variations of the included components within the percentage concentrations characteristic of the present invention, may also be regulated within such different values that the pyrotechnical charge may be manufactured as either a delay or an ignition charge renders the pyrotechnical charge according to the present invention doubly interesting.

The pyrotechnical charge according to the present invention may thus be given a desired rate of burning of between 3 and 150 mm/sec. by a combination of up to 20 % by weight of boron (B), 6–60 % by weight of zirconium (Zr), titanium (Ti) or, zirconium-nickel alloys (Zr/Ni), up to 70 % by weight of lead dioxide ($PbO_2$), up to 70 % by weight of tin dioxide ($SnO_2$), up to 3.0 % by weight of zinc (Zn) or alternatively aluminum (Al) stearate, up to 45 % by weight of titanium dioxide ($TiO_2$), up to 60 % by weight of bismuth trioxide ($Bi_2O_3$), and 0.5–5.0 % by weight of aqueous dispersible acrylate binder, and possible impurities in normal concentrations, all mixed in water and dried and granulated, a well as possibly dry-compacted to charges or pellets of the desired size, shape and density.

Of the included components, the acrylate is added for simple reasons of mechanical strength, since it does not impart any improved burning properties to the pyrotechnical charge, but rather somewhat reduces its burning rate, while the major function of the stearate addition is to increase the compressibility of the batch and to reduce its sensitivity to friction. Other components are included to provide the desired burning rate and burning intensity.

As far as the other components are concerned, it applies according to the present invention that the lead dioxide, the bismuth trioxide and zinc stearate are never included in the delay charges where a calm burning process is desired, but only in ignition charges where a cascade-like burning is desired, while tin dioxide and titanium dioxide are never included in the ignition charges. This will give the following general compositions for delay charges and ignition charges, respectively, according to the invention.

| % per weight | Delay charges | Ignition charges |
|---|---|---|
| Boron | 3–20 | 0–20 |
| Zirconium, titanium or alternatively zirconium-nickel alloys | 6–20 | 40–60 |
| Lead dioxide | 0 | up to 70 |
| Tin dioxide | 20–70 | 0 |
| Zinc or alternatively aluminum stearate | 0 | up to 3.0 |
| Titanium dioxide | 10–45 | 0 |
| Bismuth trioxide | 0 | up to 60 |
| Binder | 0.5–5.0 | 0.5–5.0 |

As was mentioned previously, the acrylate binder shall be an aqueous dispersion and shall not influence the burning properties of the pyrotechnical charge more than is necessary. Moreover, naturally, the binder shall not contain components which have not reacted to completion and which, in the long term, may affect the storage life of the pyrotechnical charge. Both of these latter requirements render certain aqueous dispersible acrylates more suitable for this purpose than others. We have, thus, found that acrylate dispersions of an anionic active character based on acrylic and metacrylic acid esters with a Tg of approximately 20° C. are extremely well suited for this purpose.

The spirit and scope of the present invention has been defined in the appended claims and will now be described in somewhat greater detail in conjunction with a number of relevant examples.

The examples under consideration here relate to pyrotechnical charges according to the present invention which are mixed in water and thereafter dried and granulated and are constituted by the compositions given below and with their accounted burning rates. In respect of the delay charges, these did not show any tendency to extinguish, while the ignition charges were considered, on the basis of experience, to have a fully adequate ignition effect.

TABLE 1

| Rate of burning in test cylinder | Delay charges (pressed form) 3 mm/s | 9 mm/s | 15 mm/s |
|---|---|---|---|
| Boron | 5% by weight | 10% by weight | 15% by weight |
| Zirconium | 8% by weight | 10% by weight | 15% by weight |
| Titanium dioxide | 28% by weight | 22% by weight | 15% by weight |
| Tin dioxide | 57% by weight | 56% by weight | 53% by weight |
| Binder | 2% by weight | 2% by weight | 2% by weight |

TABLE 2

| Rate of burning in test cylinder | Ignition charges (pressed form) 12 mm/s | 100 mm/s | 50 mm/s |
|---|---|---|---|
| Zirconium-nickel alloy | 45% by weight | — | — |
| Zirconium | — | 48% by weight | 48% by weight |
| Lead dioxide | 50% by weight | 47% by weight | — |
| Zinc stearate | 2% by weight | 2% by weight | 1% by weight |
| Bismuth trioxide | — | — | 49% by weight |
| Binder | 3% by weight | 3% by weight | 2% by weight |

What we claim and desire to secure by letters patent is:

1. A method of producing pyrotechnical delay and ignition charges with burning rates of between 3 and 150 mm/sec., characterized in that the solid components included therein, comprising up to 20 % by weight of boron (B)

6–60 % by weight of zirconium (Zr), titanium (Ti) and/or zirconium-nickel alloys (Zr/Ni)

up to 70 % by weight of lead dioxide ($PbO_2$)

up to 70 % by weight of tin dioxide ($SnO_2$)

up to 3.0 % by weight of zinc stearate or alternatively aluminum stearate, and up to 45 % by weight of titanium dioxide ($TiO_2$)

up to 60 % by weight of bismuth trioxide ($Bi_2O_3$)

are mixed in water in which an aqueous dispersible acrylate binder has been dispersed in an amount corresponding to 0.3–5.0 % by weight whereafter the thus obtained mixture is granulated, dewatered and dried.

2. A method of producing pyrotechnical delay charges in accordance with the method as claimed in claim 1, characterized in that the solid components included therein, comprising 3–20 % weight of boron (B)

6–20 % by weight of zirconium (Zr), titanium (Ti) or zirconium-nickel alloys (Zr/Ni)

10–45 % by weight of titanium dioxide ($TiO_2$), and

20–70 % by weight of tin dioxide ($SnO_2$)

are mixed in water in which 0.5–5.0 % by weight of an aqueous dispersible acrylate binder has been dispersed, whereafter the mixture is granulated, dewatered and dried.

3. A method of producing pyrotechnical ignition charges in accordance with the method as claimed in claim 1, characterized in that the solid components included therein, comprising 40–60 % by weight of zirconium (Zr), titanium (Ti) or zirconium-nickel alloys (Zr/Ni)

up to 70 % by weight of lead dioxide ($PbO_2$)

up to 60 % by weight of bismuth trioxide ($Bi_2O_3$), and up to 3.0 % by weight of zinc stearate or aluminum stearate are mixed in water in which 0.5–5.0 % by weight of an aqueous dispersible binder has been dispersed, whereafter the mixture is granulated, dewatered and dried.

4. The method as claimed in claim 1, characterized in that the obtained granules are formed into a united body of desired size and shape.

5. The method as claimed in claim 2, characterized in that the obtained granules are formed into a united body of desired size and shape.

6. The method as claimed in claim 3, characterized in that the obtained granules are formed into a united body of desired size and shape.

* * * * *